US011002476B2

(12) United States Patent
Yan et al.

(10) Patent No.: US 11,002,476 B2
(45) Date of Patent: May 11, 2021

(54) ICE MAKER HAVING A SPLASH COVER

(71) Applicant: Haier US Appliance Solutions, Inc., Wilmington, DE (US)

(72) Inventors: Bo Yan, Shanghai (CN); Daqing Gong, Shanghai (CN); Eddy Zhou, Shanghai (CN); Jason Jiang, Shanghai (CN); Yayu Song, Shanghai (CN); Michael Zhou, Shanghai (CN); Roy Teng, Shanghai (CN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 110 days.

(21) Appl. No.: 16/371,279

(22) Filed: Apr. 1, 2019

(65) Prior Publication Data

US 2020/0309446 A1 Oct. 1, 2020

(51) Int. Cl.

| | |
|---|---|
| ***F25D 23/02*** | (2006.01) |
| ***F25C 1/10*** | (2006.01) |
| ***F25C 1/24*** | (2018.01) |
| ***F25C 1/25*** | (2018.01) |
| ***F25C 5/182*** | (2018.01) |
| ***F25C 5/06*** | (2006.01) |

(52) U.S. Cl.

CPC ..... *F25D 23/028* (2013.01); *F25C 1/24* (2013.01); *F25C 1/25* (2018.01); *F25C 5/06* (2013.01); *F25C 5/182* (2013.01); *F25C 2500/06* (2013.01)

(58) Field of Classification Search

CPC ..... F25C 5/06; F25C 2500/06; F16F 2230/30

See application file for complete search history.

(56) References Cited

U.S. PATENT DOCUMENTS

| | | | | |
|---|---|---|---|---|
| 3,273,353 | A * | 9/1966 | Horvay | F25C 5/06 62/353 |
| 5,177,980 | A * | 1/1993 | Kawamoto | F25C 1/04 62/353 |
| 6,032,480 | A * | 3/2000 | Kim | F25D 17/045 62/187 |
| 7,017,364 | B2 * | 3/2006 | Lee | F25C 1/04 62/351 |
| 8,109,114 | B2 * | 2/2012 | Lee | F25C 1/10 62/353 |
| 8,534,087 | B2 * | 9/2013 | Lee | F25C 5/08 62/345 |
| 8,689,578 | B2 * | 4/2014 | Lee | F25C 1/24 62/356 |

(Continued)

FOREIGN PATENT DOCUMENTS

| | | |
|---|---|---|
| KR | 100764305 B1 | 10/2007 |
| WO | WO2014161798 A1 | 10/2014 |

*Primary Examiner* — Christopher R Zerphey

(74) *Attorney, Agent, or Firm* — Dority & Manning, P.A.

(57) ABSTRACT

An ice maker may include an assembly frame, an ice tray, a cam, a splash cover, and a biasing spring. The ice tray may define a cell for receipt of water for freezing and may be rotatably attached to the assembly frame to rotate about an axial direction. The cam may be attached to the ice tray and extend along the axial direction. The splash cover may be slidably attached to the assembly frame in mechanical communication with the cam to move between an elevated position and a lowered position according to a rotational position of the cam. The biasing spring may be disposed on the splash cover and urge the splash cover to the lowered position.

14 Claims, 13 Drawing Sheets

(56) References Cited

U.S. PATENT DOCUMENTS

| | | | | |
|---|---|---|---|---|
| 10,174,988 | B2 * | 1/2019 | Heinrich | F25D 19/003 |
| 2010/0064716 | A1 * | 3/2010 | Park | F25D 23/04 62/340 |

* cited by examiner

ICE MAKER HAVING A SPLASH COVER

FIELD OF THE INVENTION

The present subject matter relates generally to an ice maker for use in, for instance, a refrigerator appliance.

BACKGROUND OF THE INVENTION

Ice makers, such as those included within refrigerator appliances, can produce a variety of ice types depending upon the particular ice maker used. For example, certain ice maker include an ice tray for receiving liquid water. One or more movable elements may be provided to help eject or remove ice once the liquid water has frozen. Some ice maker include an ejector that can rotate and scrape ice off an internal surface of the ice tray to form ice cubes. Other ice maker are configured to rotate or twist the ice tray such that ice cubes are able to fall out of the ice tray (e.g., as motivated by gravity).

Since a portion of the ice tray must be generally open (e.g., to the surrounding environment) in order to receive liquid water or permit ice cubes to escape, there is a risk for water or stray ice to spill from the ice tray. For example, water may be splashed to the surrounding region (e.g., on the outer portion of the ice tray or the walls of a freezer compartment). Over time, ice may accumulate in unintended regions of a refrigerator appliance and even lead to dame. In certain configurations, water may fall into an ice bucket where previously-formed ice cubes are held. The water may then freeze multiple ice cubes together, creating a frozen mass that is unusable or difficult to remove.

As a result, there is a need for a refrigerator or ice maker that addresses one or more of these issues. In particular, it may be advantageous to provide an ice maker with one or more features for preventing liquid water or stray ice cubes from spilling from an ice tray to an undesired surrounding area.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ice maker is provided. The ice maker may include an assembly frame, an ice tray, a cam, a splash cover, and a biasing spring. The ice tray may define a cell for receipt of water for freezing. The ice tray may be rotatably attached to the assembly frame to rotate about an axial direction. The cam may be attached to the ice tray to rotate therewith. The cam may extend along the axial direction. The splash cover may be slidably attached to the assembly frame in mechanical communication with the cam to move between an elevated position and a lowered position according to a rotational position of the cam. The biasing spring may be disposed on the splash cover. The biasing spring may urge the splash cover to the lowered position.

In another exemplary aspect of the present disclosure, an ice maker is provided. The ice maker may include an assembly frame, an ice tray, a cam, a splash cover, and a plurality of biasing springs. The ice tray may define a cell for receipt of water for freezing. The ice tray may be rotatably attached to the assembly frame to rotate about an axial direction. The cam may be attached to the ice tray to rotate therewith. The cam may extend along the axial direction.

The splash cover may be slidably attached to the assembly frame in mechanical communication with the cam to move along a non-rotational, vertical path between an elevated position and a lowered position according to a rotational position of the cam. The plurality of springs may be disposed on the splash cover. The plurality of springs may urge the splash cover to the lowered position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
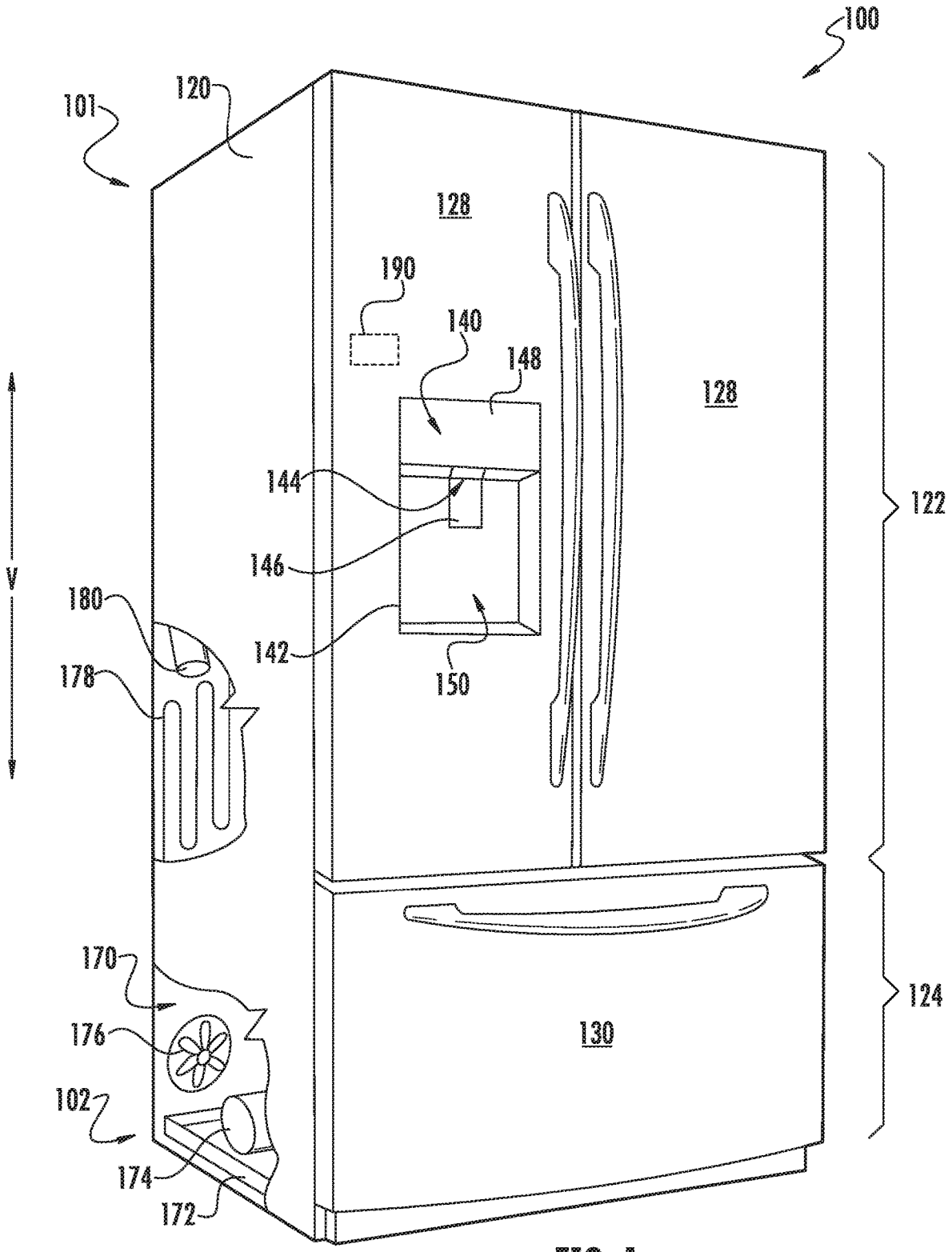
FIG. 1 provides a perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Turning now to the figures, FIG. 1 provides a perspective view of a refrigerator appliance 100 according to exemplary embodiments of the present disclosure. Refrigerator appliance 100 includes a cabinet or housing 120 that extends between a top portion 101 and a bottom portion 102 along a vertical direction V. Housing 120 defines chilled chambers for receipt of food items for storage. In particular, housing 120 defines fresh food chamber 122 positioned at or adjacent top portion 101 of housing 120 and a freezer chamber 124 arranged at or adjacent bottom portion 102 of housing 120. As such, refrigerator appliance 100 is generally referred to as a bottom mount refrigerator. It is recognized, however, that the benefits of the present disclosure apply to other types and styles of refrigerator appliances such as, for example, a top mount refrigerator appliance or a side-by-side style refrigerator appliance. Consequently, the description set forth herein is for illustrative purposes only and is not intended to be limiting in any aspect to any particular chilled chamber configuration.

In some embodiments, refrigerator doors 128 are rotatably hinged to an edge of housing 120 for selectively accessing fresh food chamber 122. A freezer door 130 is arranged below refrigerator doors 128 for selectively accessing freezer chamber 124. Freezer door 130 may be coupled to a freezer drawer (not shown) slidably mounted within freezer chamber 124. Refrigerator doors 128 and freezer door 130 are shown in a closed configuration in FIG. 1.

Refrigerator appliance 100 also includes a dispensing assembly 140 for dispensing liquid water or ice. Dispensing assembly 140 includes a dispenser 142 positioned on or mounted to an exterior portion of refrigerator appliance 100 (e.g., on one of doors 128). Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (e.g., an ultrasonic sensor) or a button rather than the paddle. In some embodiments, a user interface panel 148 is provided for controlling the mode of operation. For example, user interface panel 148 may include a plurality of user inputs (not labeled), such as a water dispensing button and an ice dispensing button, for selecting a desired mode of operation such as crushed or non-crushed ice.

In the illustrated embodiments, discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 128. In the exemplary embodiment, dispenser recess 150 is positioned at a level that approximates the chest level of a user.

Operation of the refrigerator appliance 100 can be regulated by a controller 190 that is operatively coupled to user interface panel 148 or various other components. User interface panel 148 provides selections for user manipulation of the operation of refrigerator appliance 100 such as, for example, selections between whole or crushed ice, chilled water, or other various options. In response to user manipulation of user interface panel 148 or one or more sensor signals, controller 190 may operate various components of the refrigerator appliance 100. Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 190 may be positioned in a variety of locations throughout refrigerator appliance 100. In the illustrated embodiments, controller 190 is located within the user interface panel 148. In other embodiments, the controller 190 may be positioned at any suitable location within refrigerator appliance 100, such as, for example, within a fresh food chamber 122, a freezer door 130, etc. Input/output ("I/O") signals may be routed between controller 190 and various operational components of refrigerator appliance 100. For example, user interface panel 148 may be in communication with controller 190 via one or more signal lines or shared communication busses.

As illustrated, controller 190 may be in communication with the various components of dispensing assembly 140 and may control operation of the various components. For example, the various valves, switches, etc. may be actuatable based on commands from the controller 190. As discussed, interface panel 148 may additionally be in communication with the controller 190. Thus, the various operations may occur based on user input or automatically through controller 190 instruction.

Figure 2:
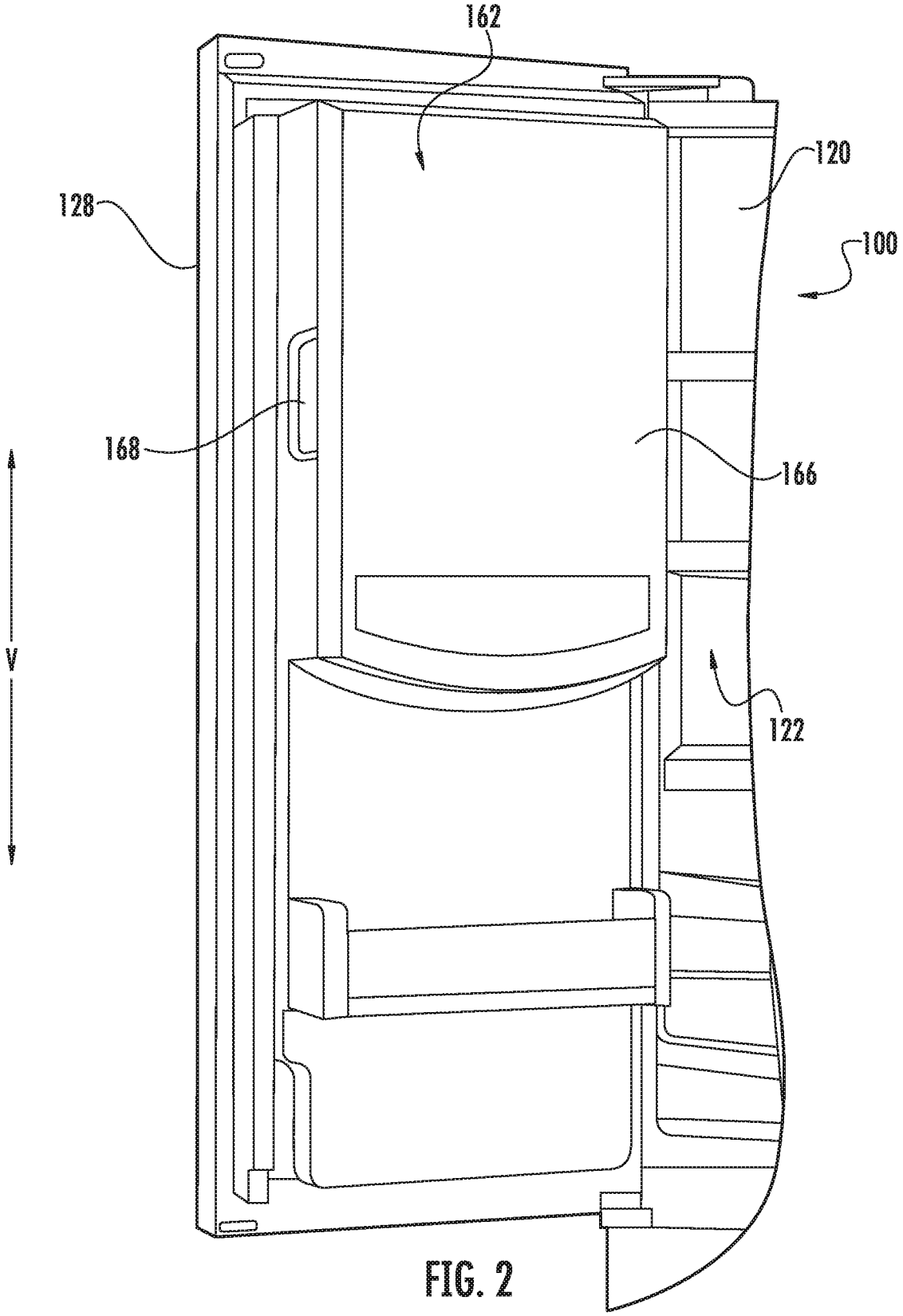
FIG. 2 provides a perspective view of a door of the exemplary refrigerator appliance of FIG. 1.
Figure 3:
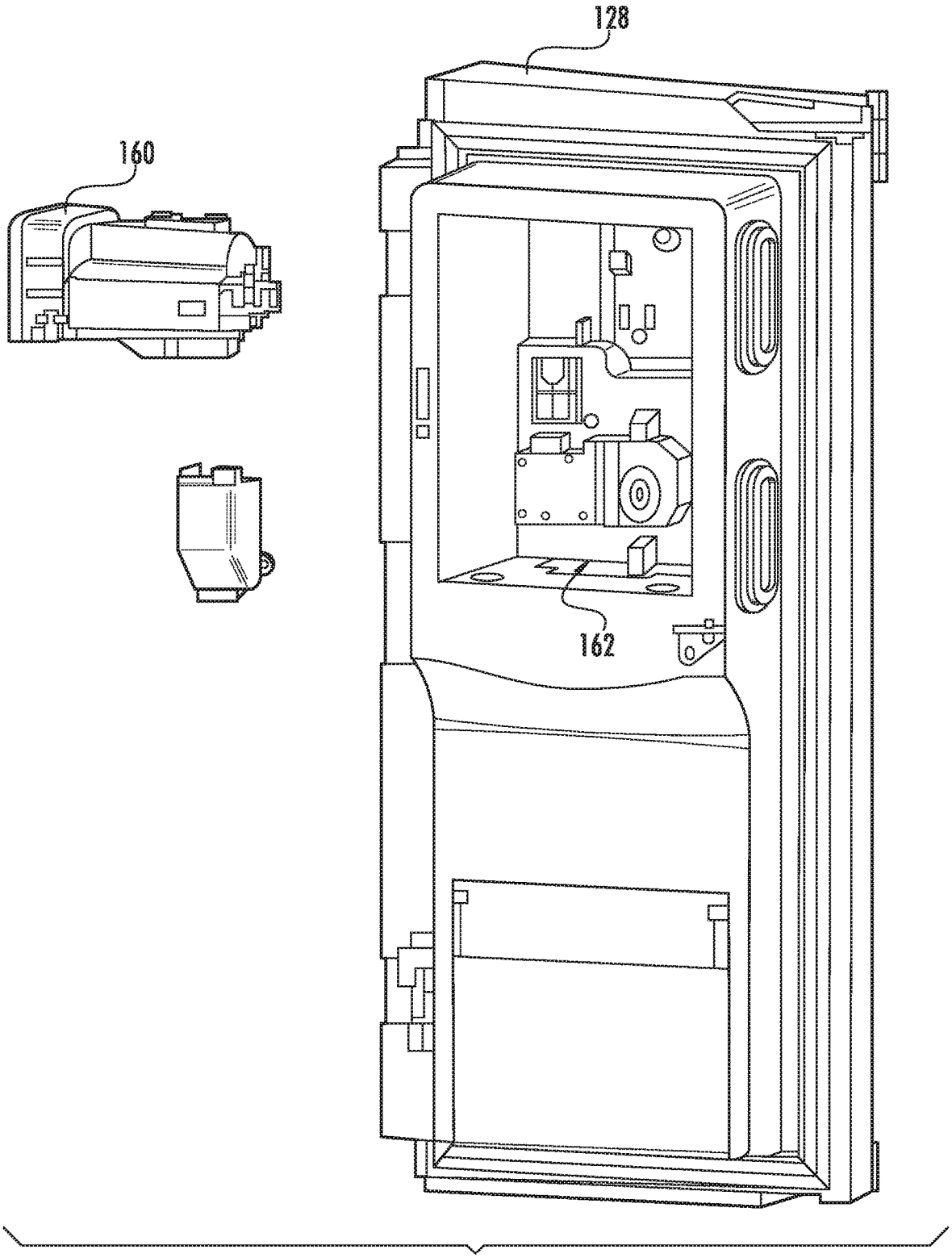
FIG. 3 provides an exploded view of a portion of the exemplary refrigerator door of FIG. 2.
Figure 4:
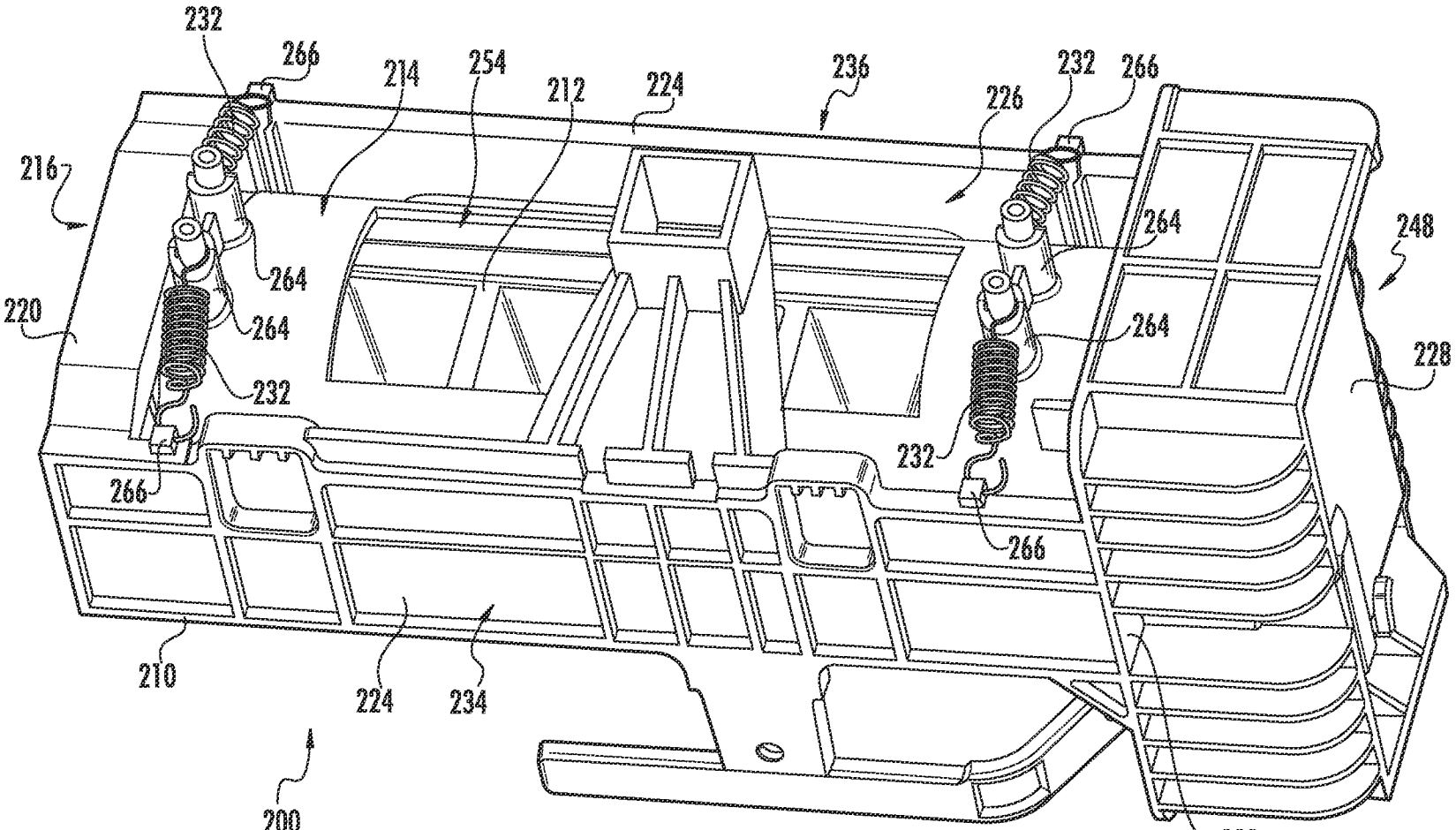
FIG. 4 provides a perspective view of an ice maker according to exemplary embodiments of the present disclosure.
Figure 5:
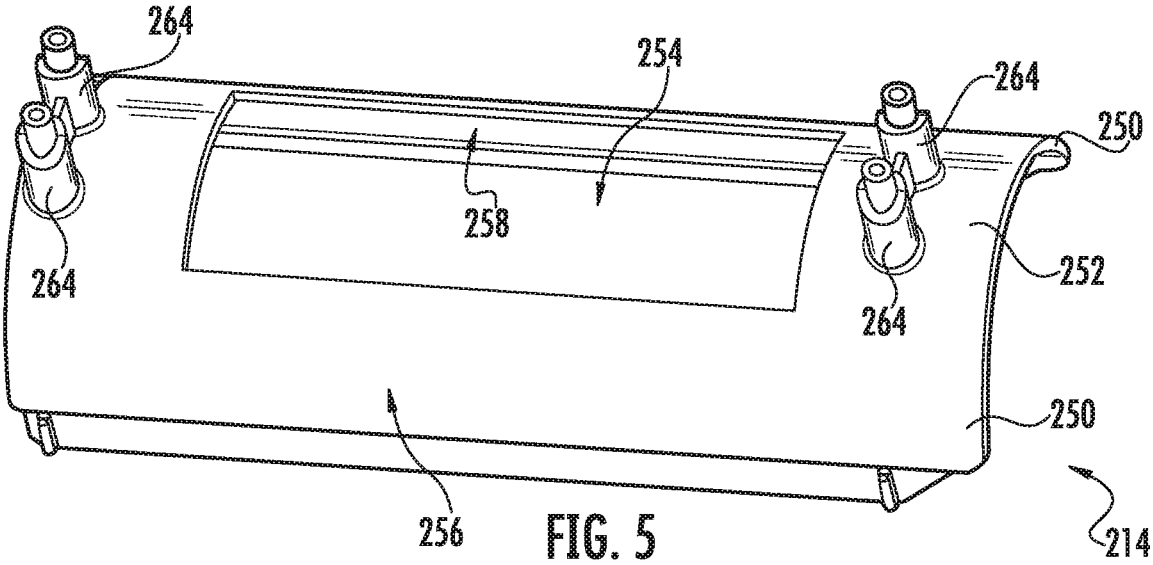
FIG. 5 provides a perspective view of the splash cover of the exemplary ice maker of FIG. 4.
Figure 6:
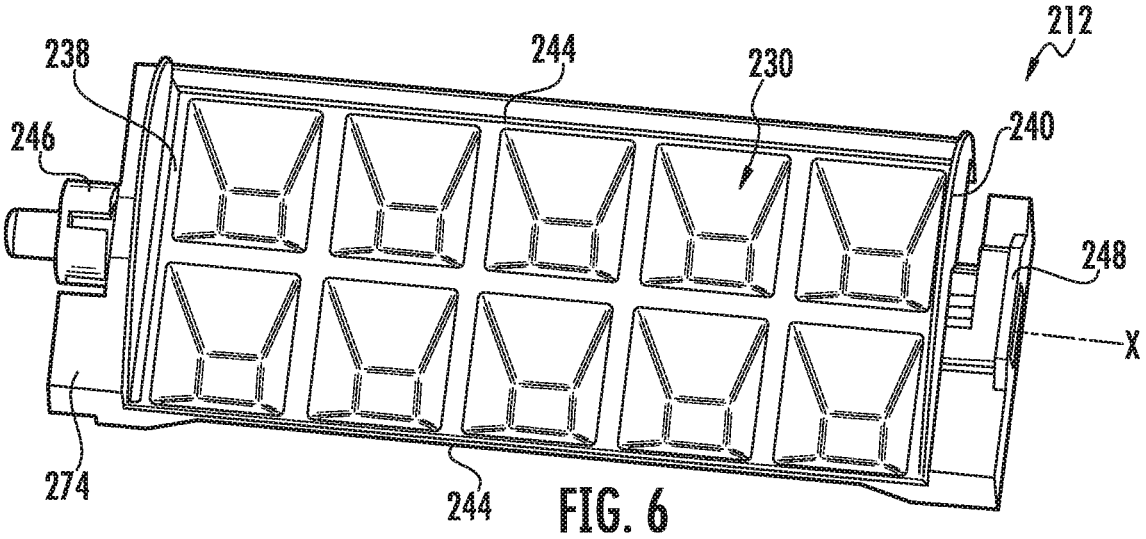
FIG. 6 provides a perspective view of the ice tray of the exemplary ice maker of FIG. 4.
Figure 7:
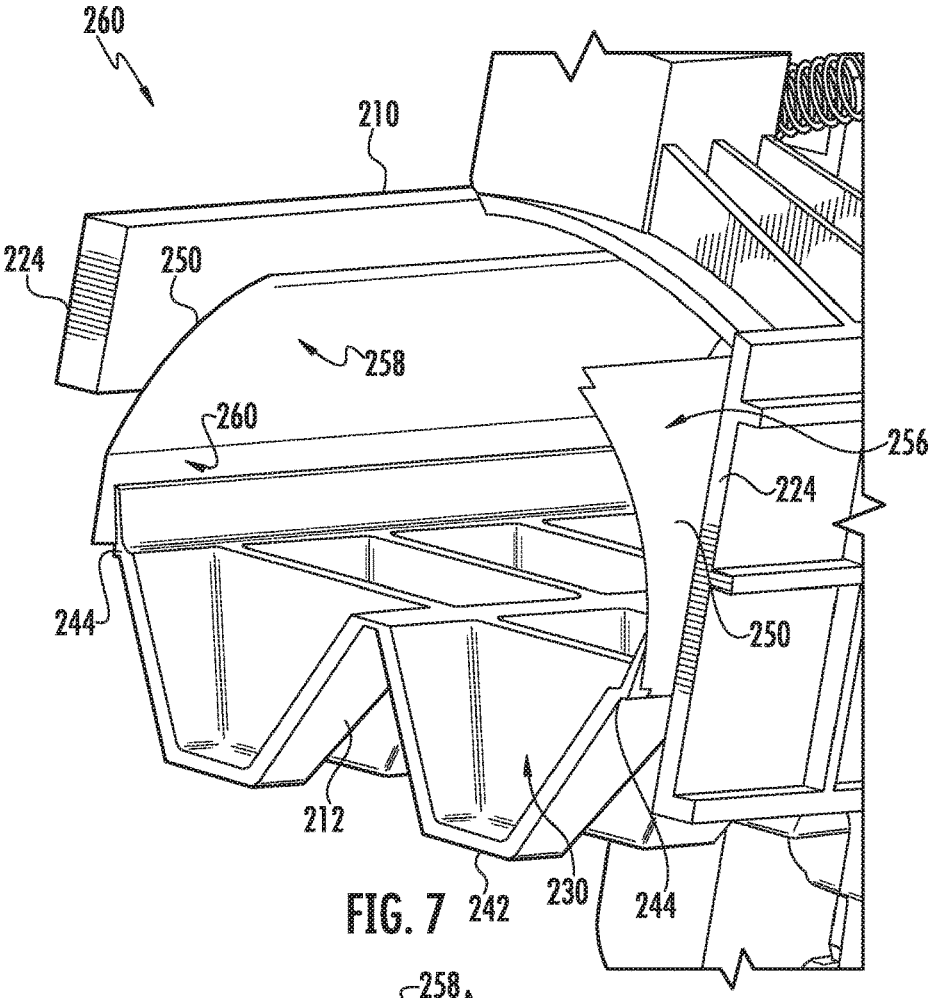
FIG. 7 provides a cross-sectional perspective view of a portion of the exemplary ice maker of FIG. 4.
Figure 8:
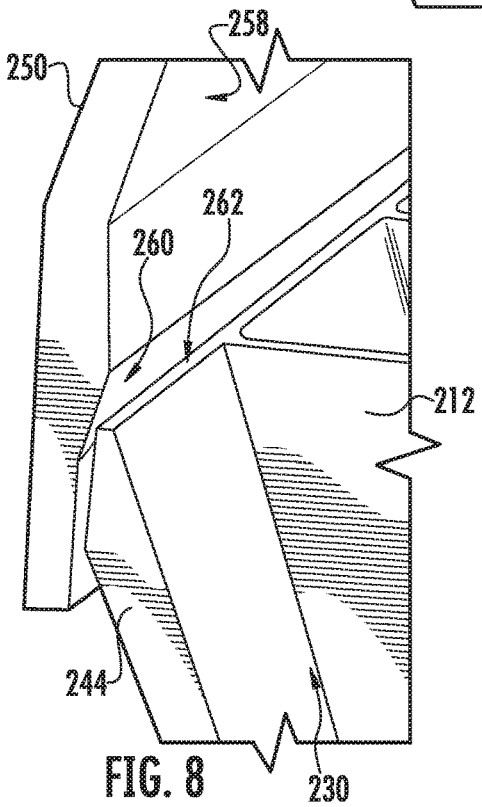
FIG. 8 provides a magnified, cross-sectional, perspective view of the splash cover and ice tray the exemplary ice maker of FIG. 4.

FIG. 2 provides a perspective view of a door of refrigerator doors 128. FIG. 3 provides an exploded view of a portion of refrigerator door 128 with an access door 166 removed. Refrigerator appliance 100 includes a sub-compartment 162 defined on refrigerator door 128. Sub-compartment 162 is often referred to as an "icebox." Moreover, sub-compartment 162 extends into fresh food chamber 122 when refrigerator door 128 is in the closed position.

Generally, ice may be supplied to dispenser recess 150 (FIG. 1) from ice maker 160 or a separate ice bin (not pictured) in sub-compartment 162 on a back side of refrigerator door 128. In optional embodiments, chilled air from a sealed refrigeration system of refrigerator appliance 100 may be directed into ice maker 160 in order to cool components of ice maker 160. For instance, an evaporator 178 (FIG. 1) may be positioned at or within fresh food chamber 122 or freezer chamber 124 and be configured for generating cooled or chilled air. A supply conduit 180 (FIG. 1) may be defined by or positioned within housing 120, extends between evaporator 178 and components of ice maker 160 in order to cool components of ice maker 160 and assist ice formation by ice maker 160.

In optional embodiments, liquid water generated during melting of ice cubes in an ice storage bin, is directed out of the ice storage bin. For example, turning back to FIG. 1, liquid water from melted ice cubes may be directed to an evaporation pan 172. Evaporation pan 172 is positioned within a mechanical compartment 170 defined by housing 120 (e.g., at bottom portion 102 of housing 120). A condenser 174 of the sealed system can be positioned, for example, directly-above and adjacent evaporation pan 172. Heat from condenser 174 can assist with evaporation of liquid water in evaporation pan 172. A fan 176 configured for cooling condenser 174 can also direct a flow air across or into evaporation pan 172. Thus, fan 176 can be positioned above and adjacent evaporation pan 172. Evaporation pan 172 is sized and shaped for facilitating evaporation of liquid water therein. For example, evaporation pan 172 may be open topped and extend across about a width or a depth of housing 120.

Access door 166 is hinged to refrigerator door 128. Access door 166 permits selective access to sub-compartment 162. Any manner of suitable latch 168 is configured with sub-compartment 162 to maintain access door 166 in a closed position. As an example, latch 168 may be actuated by a consumer in order to open access door 166 for providing access into sub-compartment 162. Access door 166 can also assist with insulating sub-compartment 162.

Turning now generally to FIGS. 4 through 9, various views are provided an exemplary ice maker 200, including portions thereof. As would be understood, exemplary ice maker 200 may be provided as (or as part of) ice maker 160.

As shown, ice maker 200 includes an assembly frame 210 that supports an ice tray 212 in which ice (e.g., ice cubes) may be formed. In some embodiments, ice maker 200 defines an axial direction X about which ice tray 212 may rotate. When assembled, assembly frame 210 extends along the axial direction X between a first frame end 216 a second frame end 218. One or more end walls 220, 222 may be provided on either end 216, 218. Optionally, assembly frame 210 may further include a pair of radial walls 224 extending between first frame end 216 and second frame end 218. In some such embodiments, the radial walls 224 (either alone or with the end walls 220, 222) may define an interior cavity 226 within which ice tray 212 is rotatably attached and within which splash cover 214 is slidably attached.

In some embodiments, an ice maker motor 228 is further attached to assembly frame 210 or ice tray 212 to selectively rotate ice tray 212 relative to assembly frame 210, as will be discussed in greater detail below. For instance, as shown, ice tray 212 may be rotatably attached to ice maker motor 228 at second frame end 218, or at another suitable location. When activated, ice maker motor 228 may thus rotate at least a portion of ice tray 212 about the axial direction X on assembly frame 210.

Along with ice tray 212, which is rotatably attached to assembly frame 210, a splash cover 214 is slidably attached to assembly frame 210. Generally, splash cover 214 is attached to assembly frame 210 above at least a portion of ice tray 212 or a cell 230. For instance, one or more biasing springs 232 may extend from splash cover 214 (e.g., mounting posts 264 provided on splash cover 214) to assembly frame 210 such that splash cover 214 is suspended on assembly frame 210 within a portion of interior cavity 226.

As shown, ice tray 212 extends along the axial direction X between a first body wall 238 and a second body wall 240. When assembled, first body wall 238 is located proximal to first frame end 216 while second body wall 240 is located proximal to second frame end 218. A pair of radial body walls 244 and a bottom body wall 242 extend between first body wall 238 and second body wall 240. As shown, the radial body walls 244 are positioned at opposite radial sides of ice tray 212.

When assembled, ice tray 212 defines one or more cells 230 within which liquid water may be received and frozen (e.g., when ice tray 212 is in a receiving position). Specifically, the body walls 238, 240, 244 define cell 230 as open on one side (e.g., opposite bottom body wall 242) and enclosed on the opposite side (e.g., bottom body wall 242) to define the shape for frozen ice within cell 230. In the illustrated embodiments, cell 230 defines a relatively cube shape. However, any suitable shape may be provided.

In some embodiments, a full cam 246 extending along the axial direction X is attached to ice tray 212. For instance, full cam 246 may extend integrally from (e.g., as a unitary monolithic element with) one end or body wall 238 or 248 of ice tray 212. In certain embodiments, full cam 246 extends from first body wall 238 (e.g., between first body wall 238 and first frame end 216 along the axial direction X). Full cam 246 may be fixed relative to ice tray 212, and thus, full cam 246 and ice tray 212 may rotate in tandem about the axial direction X.

In additional or alternative embodiments, a partial cam 248 extending along the axial direction X is attached to ice tray 212 (e.g., separate from or in addition to full cam 246). For instance, partial cam 248 may extend axially from (e.g., as a unitary monolithic element with) one end or body wall 238 or 248 of ice tray 212. In certain embodiments, partial cam 248 extends from second body wall 240 (e.g., between second body wall 240 in second frame end 218 along the axial direction X). Partial cam 248 may be fixed relative to ice tray 212, and thus, partial cam 248 and ice tray 212 may rotate in tandem about the axial direction X.

In some embodiments, splash cover 214 may extend along (e.g., in parallel with) at least a portion of ice tray 212 along the axial direction X. In particular, one or more outer wall segments 250 may extend between first body wall 238 and second body wall 240 (e.g., along a length that spans from first body wall 238 when ice tray 212 is in the receiving position). In some such embodiments, outer wall segments 250 are formed along an arc defined about the axial direction X. In other words, outer wall segment 250 may be an arcuate outer wall segment 250 extending partially about the axial direction X (e.g., not completely about the axial direction X such that the axial direction X is not bounded by 360°). Optionally, a pair of outer wall segments 250 may be matched to the pair of radial body walls 244 of ice tray 212. When assembled, the pair of outer wall segments 250 may be disposed at opposite radial sides 234, 236 of assembly frame 210 such that each outer wall segment 250 is disposed radially outward from ice tray 212 (e.g., radially outward relative to the axial direction X).

In further embodiments, splash cover 214 includes an intermediate wall segment 252 that extends between the pair of outer wall segments 250. For instance, intermediate wall segment 252 may follow the same arcuate path followed or defined by the pair of outer wall segments 250 about the axial direction X. Moreover, intermediate wall segment 252 may define a central passage 254 through which water may be received (e.g., upstream from cell 230 for freezing therein).

When ice tray 212 is in the receiving position, each outer wall segment 250 may radially bound a separate corresponding radial body wall 244. In other words, each outer wall segment 250 may be positioned radially outward from the corresponding radial body wall 244. Together, outer wall segments 250 may at least partially enclose ice tray 212 and cell 230. Advantageously, liquids (e.g., water) directed to or splashed from cell 230 may be contained by outer wall segments 250 and may be prevented from passing to the surrounding environment (e.g., sub-compartment 162—FIG. 3). In particular, advantageous containment of liquids (e.g., water) may be pronounced as a door 128 is opened or closed, since water within ice tray 212 may be otherwise especially prone to splash therefrom.

Each outer wall segment 250 generally includes an outer surface 256 and an inner surface 258. When assembled, the outer surface 256 faces away from the axial direction X (i.e., outward), and the inner surface 258 faces toward the axial direction X (i.e., inward). As illustrated in, for example, FIGS. 7 and 8, one or more of outer wall segments 250 may define a radial lip 260 to rest over or against a corresponding radial side of ice tray 212 when ice tray 212 is in the receiving position. Specifically, a radial lip 260 may be defined by the inner surface 258 and extend along a top surface 262 of the corresponding radial side of ice tray 212 (e.g., radially inward from at least a portion of ice tray 212 and another portion of inner surface 258). When ice tray 212 is in the receiving position radial lip 260 may be engaged (e.g., in contact with) top surface 262, thereby further restricting liquids or solids within cell 230 from passing to the surrounding environment.

Returning generally to FIGS. 4 through 9, one or more suitable biasing springs 232 are disposed on splash cover 214 to urge or bias splash cover 214 downward (e.g., to a lowered position) and toward at least a portion of ice tray 212. Optionally, at least one pair of biasing springs 232 is disposed on opposite radial sides of splash cover 214 (e.g., to prevent rotation of splash cover 214 about the axial direction X between an elevated position and a lowered position). In other words, at least one biasing spring 232 is provided proximal to one side 234 while at least one other biasing spring 232 is provided proximal to the opposite side 236. Additionally or alternatively, two or more biasing springs 232 are disposed proximal to opposite axial ends of splash cover 214 (e.g., to prevent rotation of splash cover 214 perpendicular to the axial direction X between an elevated position and a lowered position). Advantageously, the mounted biasing springs 232 may generally guide splash cover 214 along a non-rotational, vertical path, as will be further described below.

When assembled, biasing springs 232 may be mounted (e.g., at one end) at a fixed position to assembly frame 210 and mounted (e.g., at an opposite end) at a movable (e.g., vertically movable) position to splash cover 214. Thus, one end of biasing spring 232 may anchor biasing spring 232 to assembly frame 210 while the opposite end moves in tandem with splash cover 214. In certain embodiments, biasing springs 232 are mounted above ice tray 212 and at least a portion of splash cover 214. As illustrated, a mounting post 264 may extend (e.g., vertically) from the outer surface 256 of splash cover 214 to hold or connect (e.g., a first end of) a corresponding biasing spring 232. A mounting tab 266 may be provided or defined on splash cover 214 (e.g., below mounting post 264) to hold or connect (e.g., an opposite or second end of) the corresponding biasing spring 232. As splash cover 214 raises (e.g., to an elevated position from a lowered position), the two ends of each biasing spring 232 may be forced apart under resistance such that splash cover 214 is urged toward ice tray 212 or axial direction X.

Figure 17:
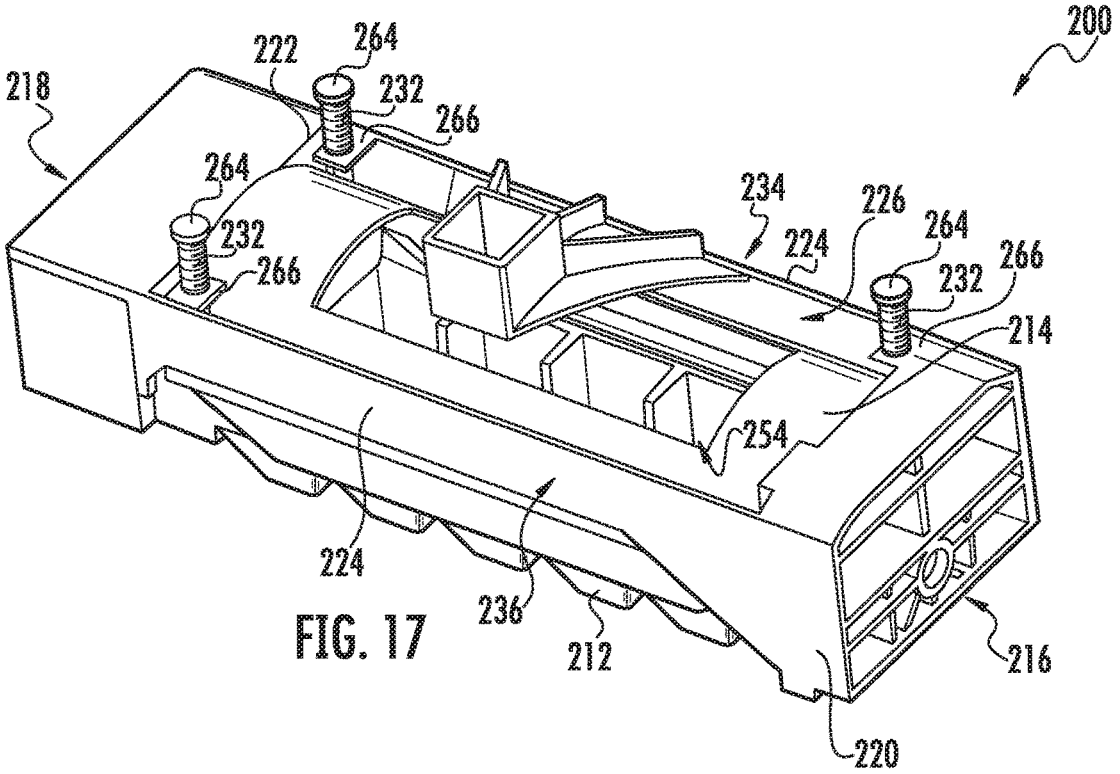
FIG. 17 provides a perspective view of an ice maker according to exemplary embodiments of the present disclosure.
Figure 18:
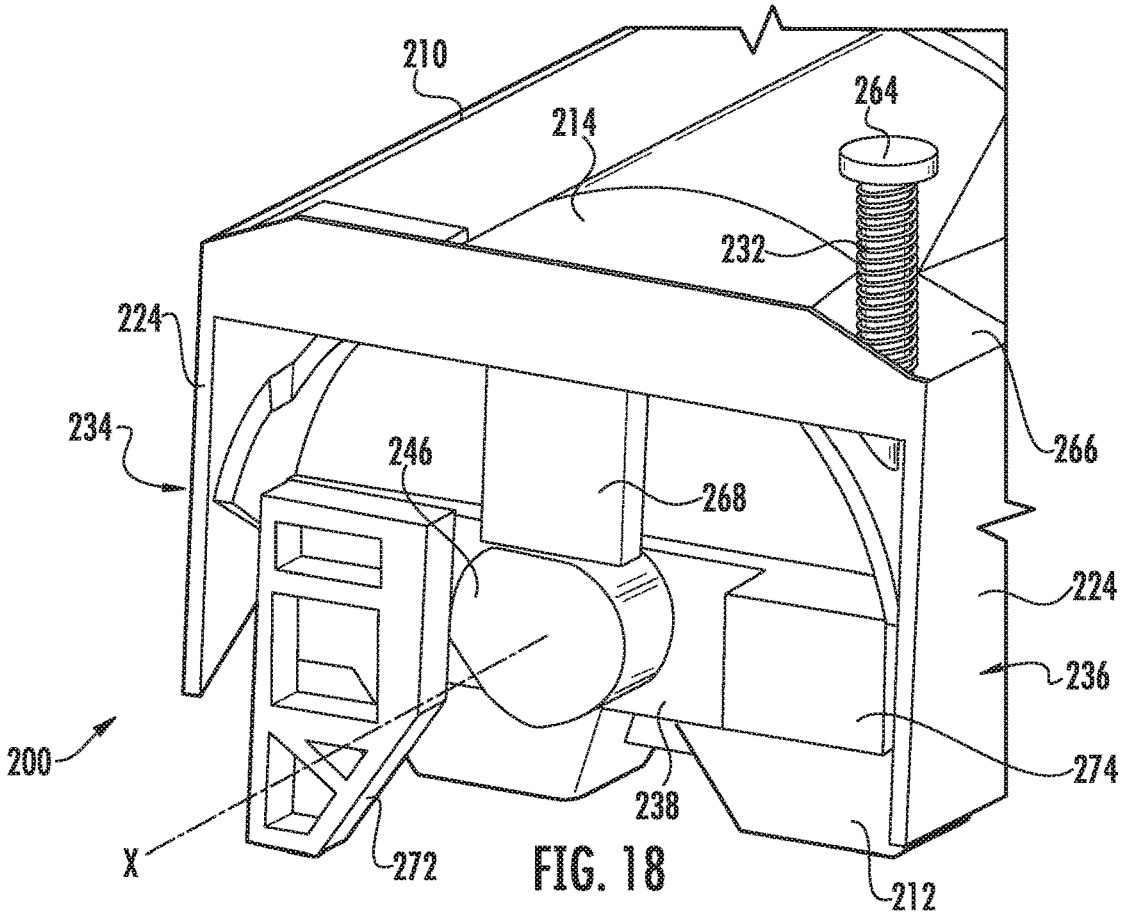
FIG. 18 provides a perspective view of one end of the exemplary ice making appliance of FIG. 17.

Although biasing springs 232 are illustrated as two pairs of helical tension springs (e.g., in FIGS. 9 through 15), it is noted that any other suitable arrangement or biasing spring (e.g., torsion spring, compression spring, hydraulic spring, gas spring, Belleville spring, etc.) may be provided in accordance with the present disclosure. For example, turning briefly to FIGS. 17 and 18, a plurality of biasing springs 232 may be provided as a set of mutually-spaced-apart compression springs. As illustrated, each mounting tab 266 may be positioned directly below the corresponding biasing spring 232. Moreover, a corresponding mounting post 264 may extend from splash cover 214 through mounting tab 266 (e.g., such that biasing spring 232 is held between an upper end of mounting post 264 and an upper end of mounting tab 266). Optionally, each biasing spring 232 may be wound about the corresponding mounting post 264. As splash cover 214 raises (e.g., to an elevated position from a lowered position), the two ends of each biasing spring 232 may be forced toward each other under resistance such that splash cover 214 is urged toward ice tray 212 or axial direction X.

Figure 9:
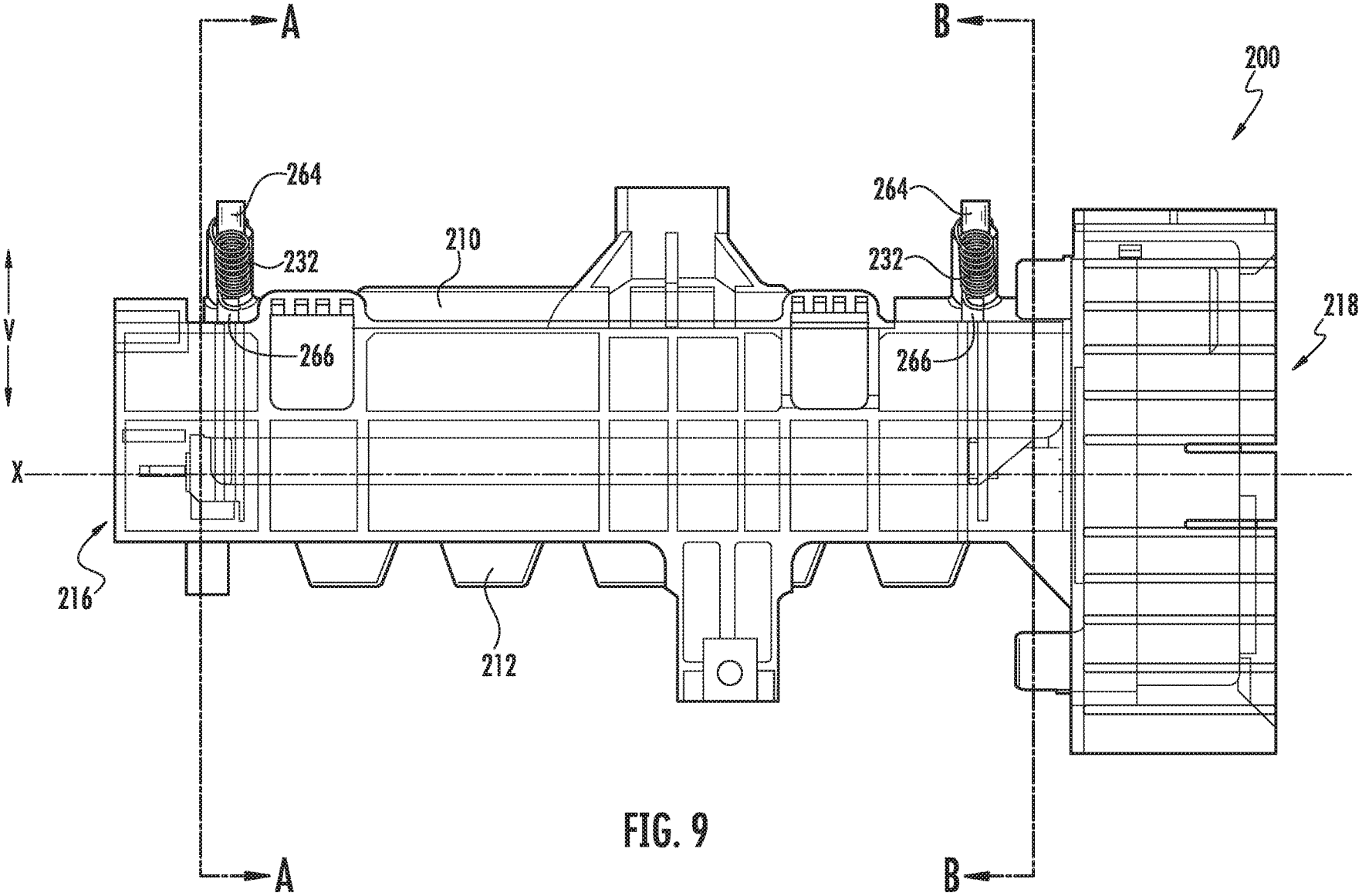
FIG. 9 provides a perspective view of the exemplary ice maker of FIG. 4.
Figure 10A:
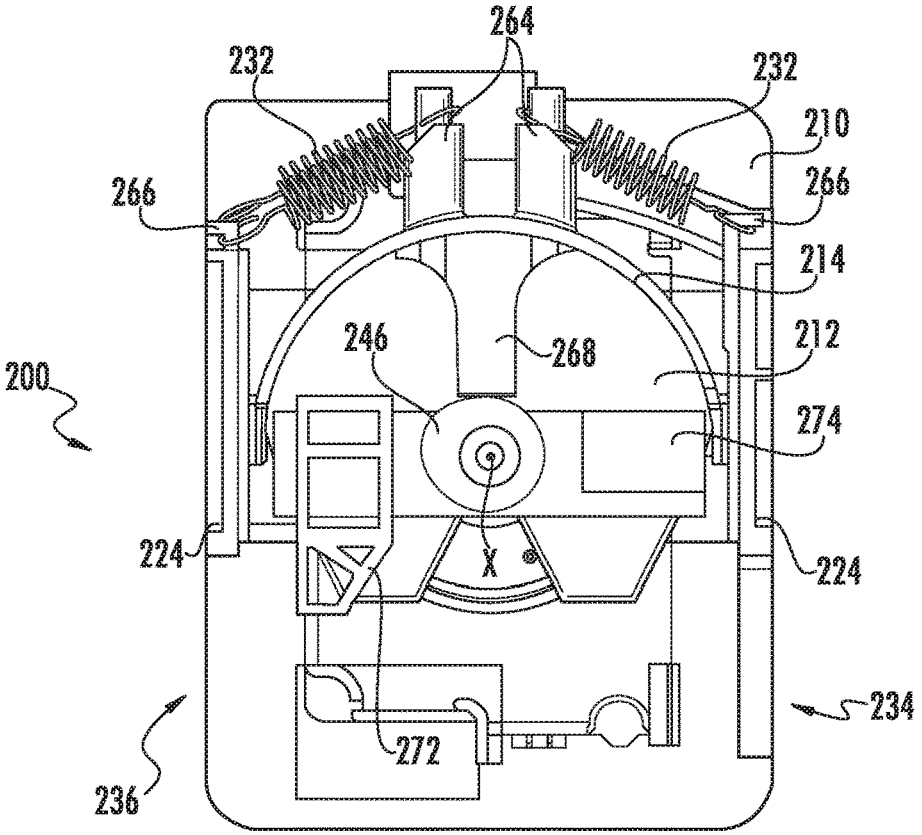
FIG. 10A provides a cross-sectional view taken along the line A-A of the exemplary ice making appliance of FIG. 9 in a receiving position.
Figure 10B:
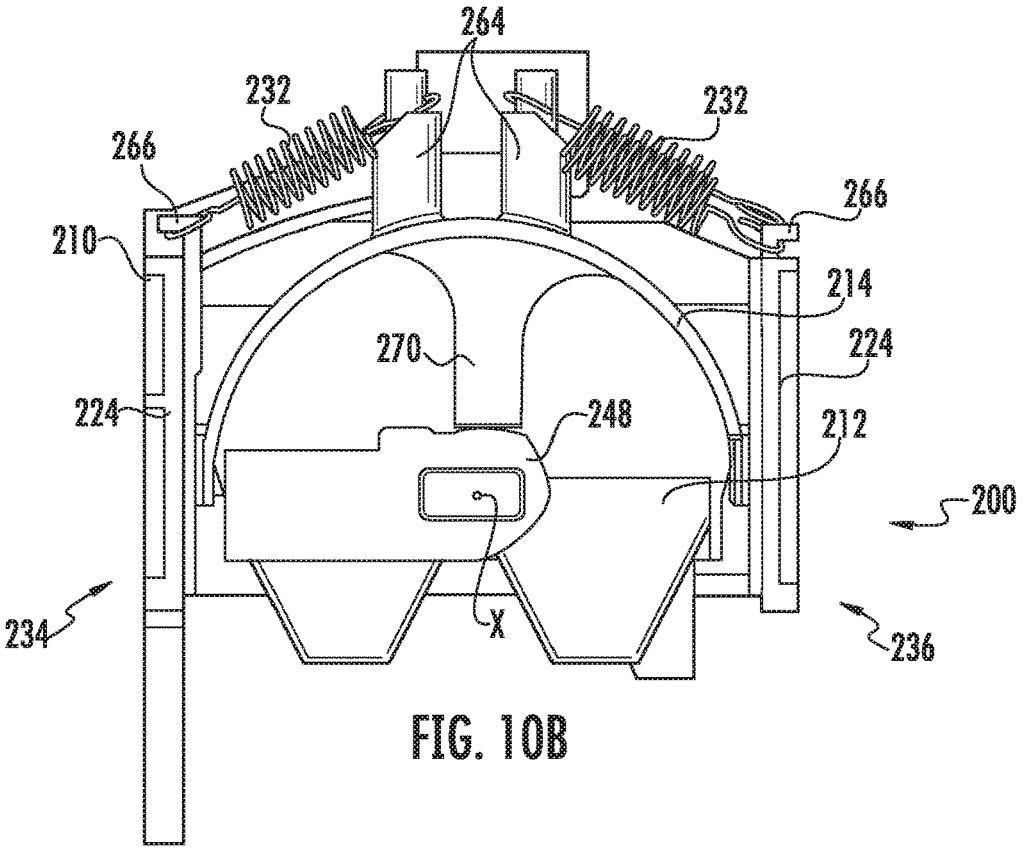
FIG. 10B provides a cross-sectional view taken along the line B-B of the exemplary ice making appliance of FIG. 9 in the receiving position.
Figure 11A:
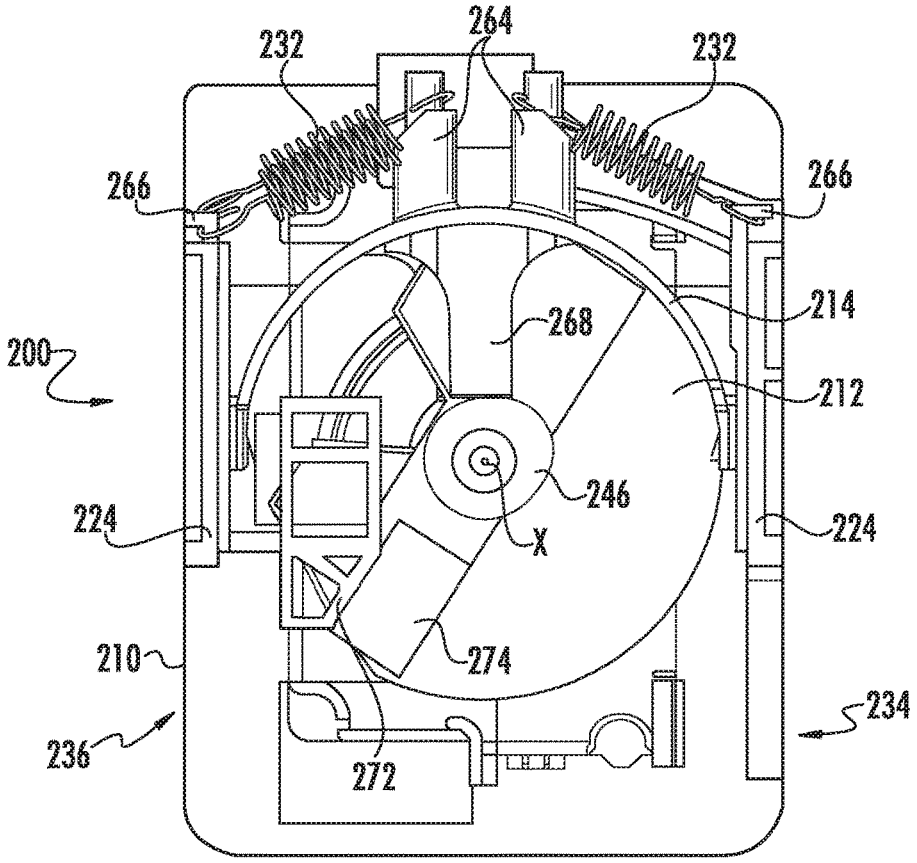
FIG. 11A provides a cross-sectional view taken along the line A-A of the exemplary ice making appliance of FIG. 9 in a deformed evacuation position.
Figure 11B:
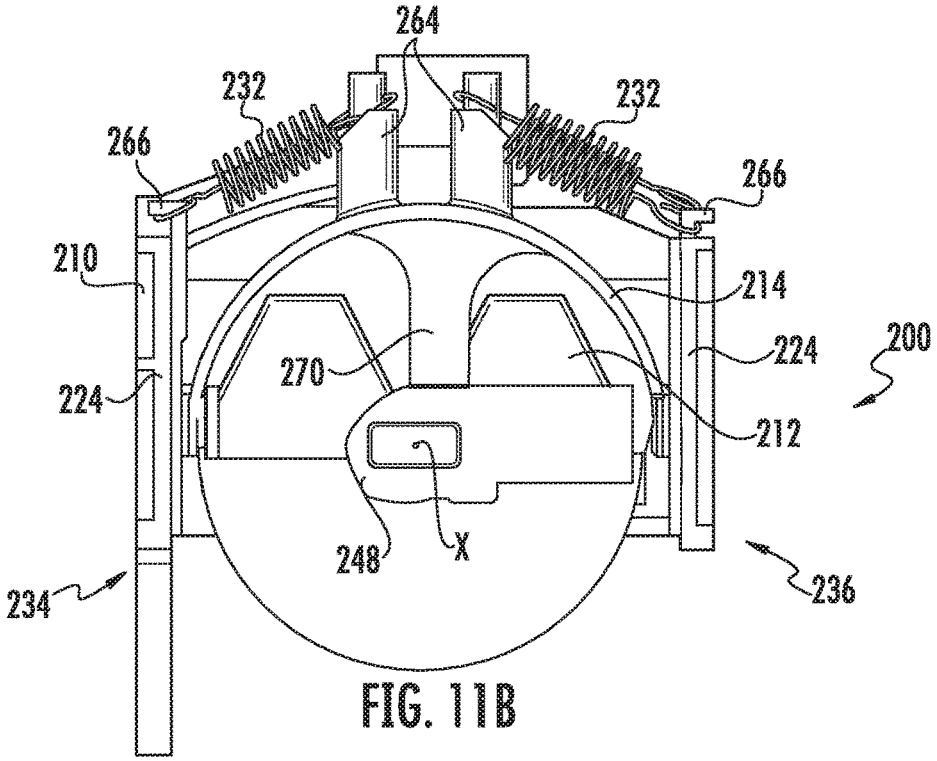
FIG. 11B provides a cross-sectional view taken along the line B-B of the exemplary ice making appliance of FIG. 9 in the deformed evacuation position.
Figure 12:
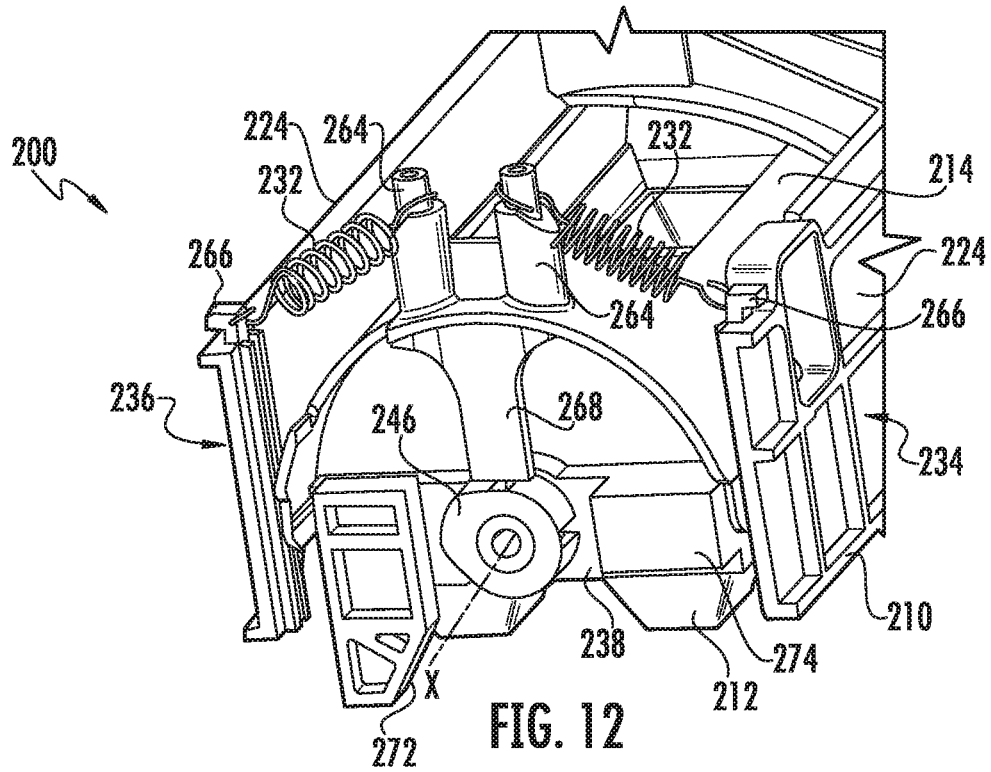
FIG. 12 provides a perspective view of one end of the exemplary ice making appliance of FIG. 4 in the receiving position.
Figure 13:
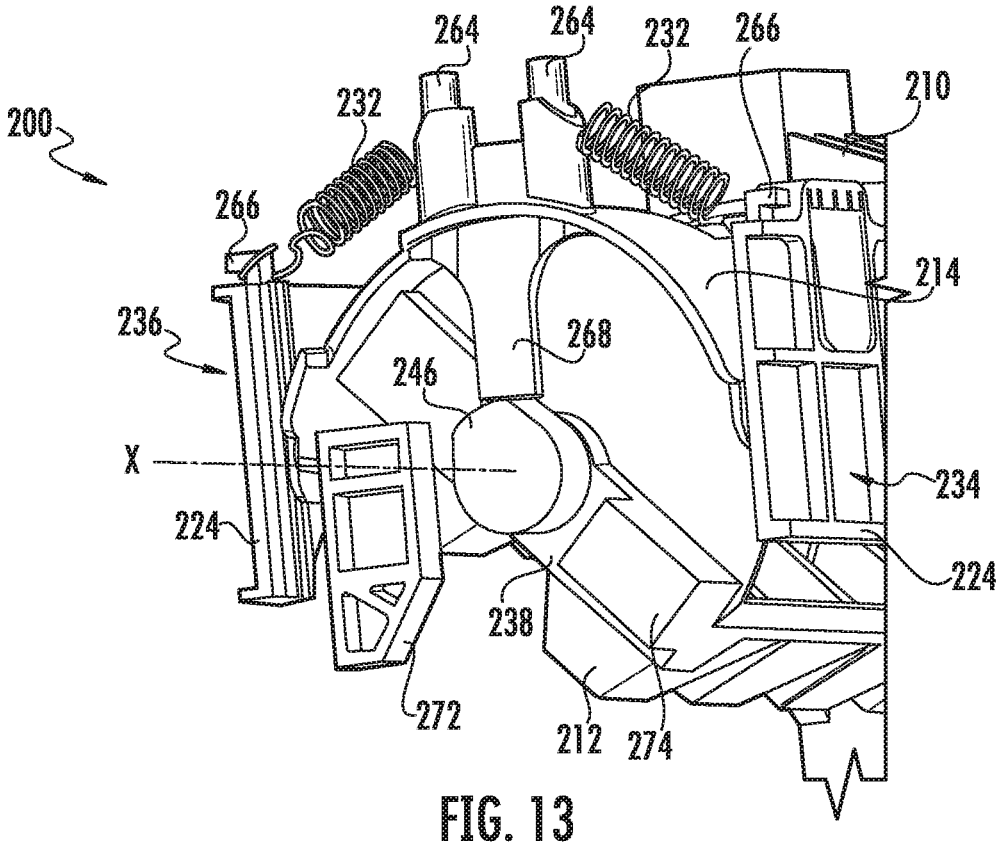
FIG. 13 provides a perspective view of one end of the exemplary ice making appliance of FIG. 4 in one intermediate position.
Figure 14:
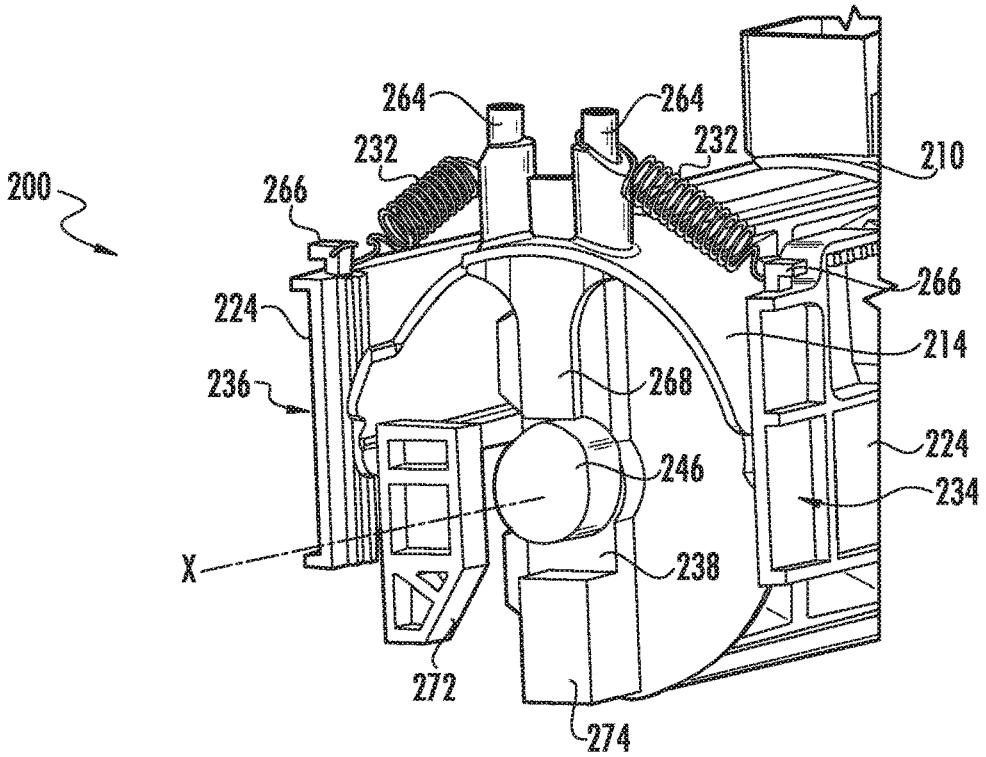
FIG. 14 provides a perspective view of one end of the exemplary ice making appliance of FIG. 4 in another intermediate position.
Figure 15:
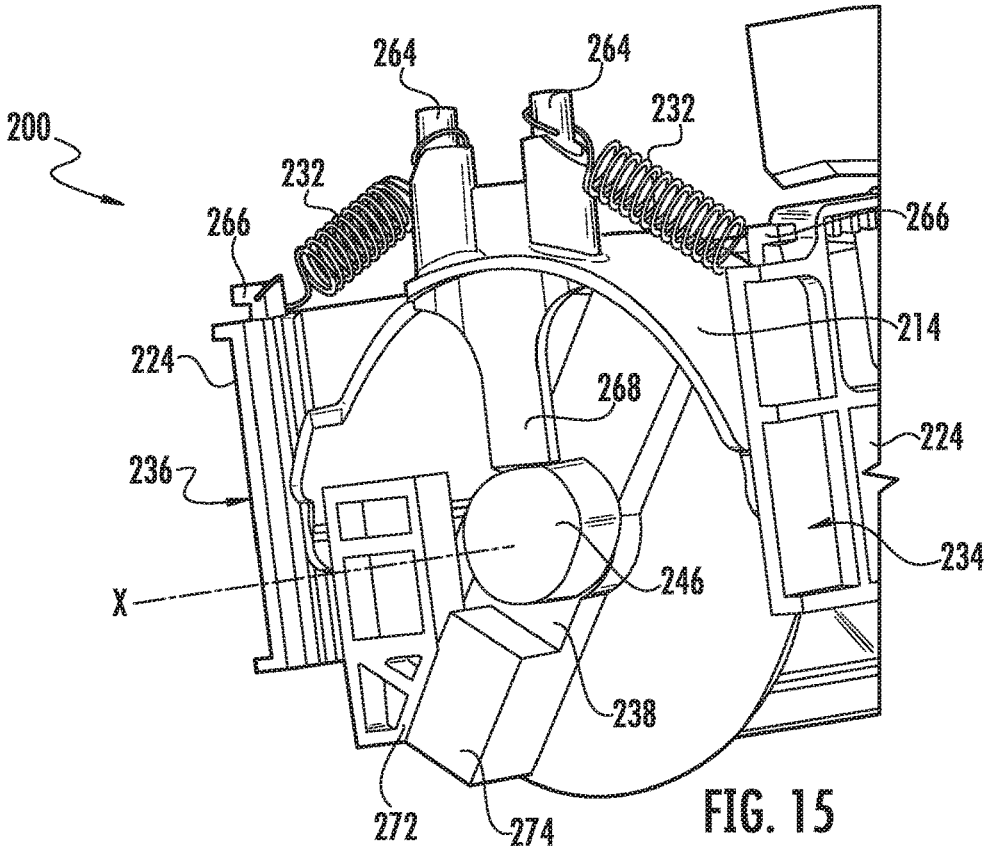
FIG. 15 provides a perspective view of one end of the exemplary ice making appliance of FIG. 4 in an evacuation position.
Figure 16:
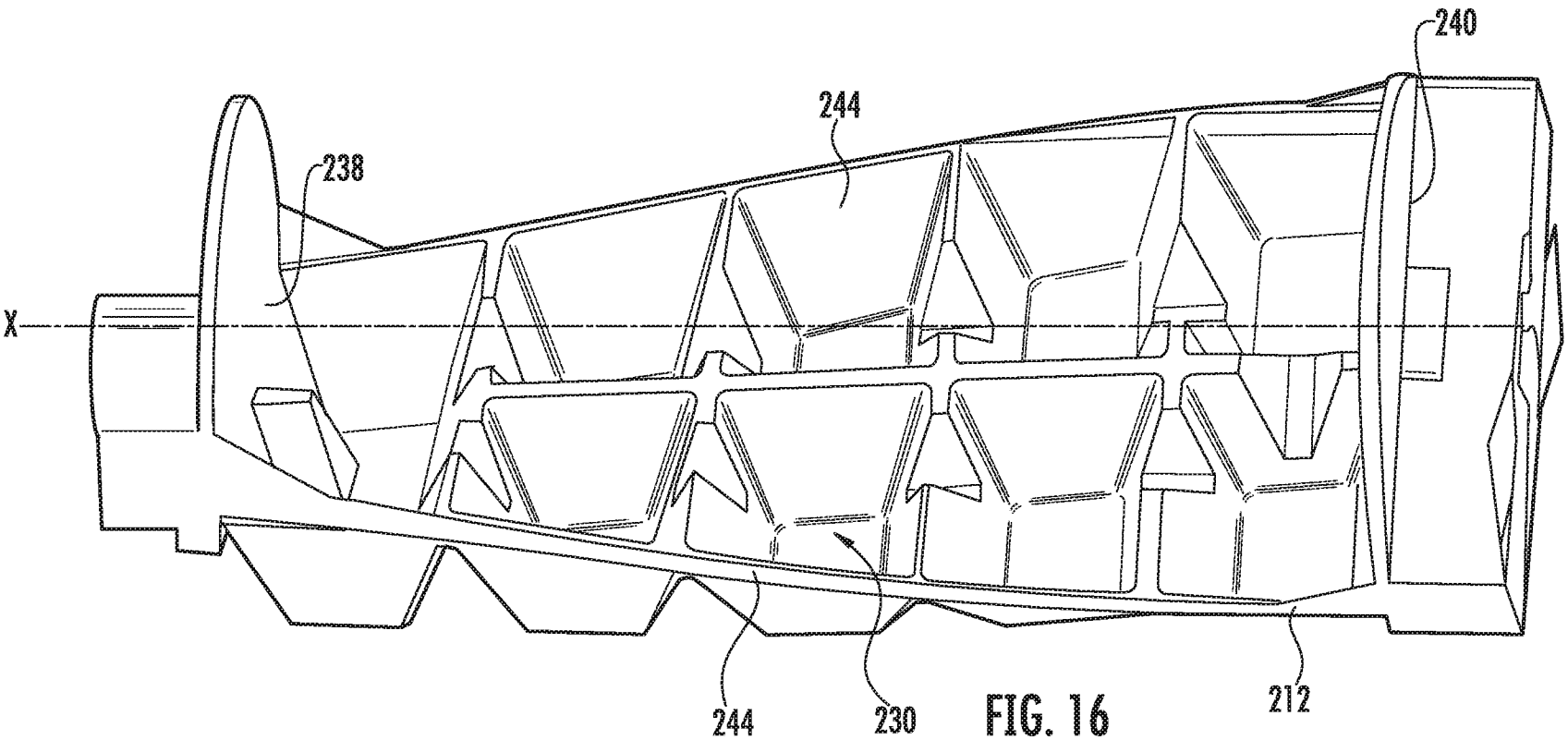
FIG. 16 provides a perspective view of the ice tray of the exemplary ice making appliance of FIG. 4 in the deformed evacuation position.

Turning now to FIGS. 9 through 16, various views are provided of ice maker 200 (or portions thereof) to illustrate movement of ice maker 200 between discrete use positions. Specifically, FIG. 9 provides a perspective view of ice maker 200. FIGS. 10A and 10B provide cross-sectional side views of ice maker 200 in a horizontal receiving position taken along the lines A-A and B-B, respectively. FIGS. 11A and 11B provide cross-sectional side views of ice maker 200 in a deformed evacuation position taken along the lines A-A and B-B, respectively. The horizontal receiving position is further illustrated by the perspective view of FIG. 12, while the deformed evacuation position is further illustrated by the perspective view of FIG. 15. FIGS. 13 and 14 illustrate intermediate positions between the receiving position and the evacuation position. FIG. 16 illustrates ice tray 212 in the evacuation position.

As shown, in the horizontal receiving position, ice tray 212 may be positioned such that cell 230 is open to receive water from above. Thus, water may be received within cell 230. In the horizontal receiving position, first body wall 238 is in circumferential alignment with second body wall 240 (e.g., relative to the axial direction X). For instance, first body wall 238 may be held in parallel to second body wall 240.

Generally, the receiving position may correspond to a lowered position of splash cover 214. Optionally, the receiving position may define the minimum height for splash cover 214 or minimal distance between splash cover 214 and the axial direction X. One or more tracking legs 270 may extend from splash cover 214 proximal to the first end or second end (e.g., at discrete locations along the axial direction X). When assembled, one tracking leg 270 may be proximal to the first frame end 216 while another tracking leg 270 may be proximal to the second frame end 218. The tracking legs 270 may be fixed relative to splash cover 214 (e.g., as integral unitary members therewith). In some such embodiments, the tracking legs 270 provide splash cover 214 in mechanical communication with one or more of the cams 246, 248. As an example, a first tracking leg 268 may extend vertically from splash cover 214 proximal to the first end to travel along the lobed surface of full cam 246. In the receiving position, first tracking leg 268 may rest on a relatively flat or thin portion of full cam 246. As another example, a second tracking leg 270 may extend proximal to the second end to travel along the partially-lobed surface of partial cam 248. In the receiving position, second tracking leg 270 may rest on a relatively flat or thin portion of partial cam 248.

Outside of the receiving position, splash cover 214 may be moved to an elevated position (e.g., FIG. 14). In other words, the elevated position may correspond to a non-receiving position of ice tray 212. For instance, an intermediate position between the receiving position and the evacuation position may correspond to the elevated position. In the elevated position, first tracking leg 268 may rest on a relatively curved or thick portion of full cam 246. Additionally or alternative, second tracking leg 270 may rest on a relatively curved or thick portion of partial cam 248. In this manner, splash cover 214 may move along a non-rotational, vertical path between an elevated position and a lowered position according to a rotational position of full cam 246 (e.g., circumferential or rotated position of full cam 246 about the axial direction X). Advantageously, splash cover 214 may be moved out of the rotational path of ice tray 212 and prevented from interfering with ice tray 212 as it rotates between the receiving position and the evacuation position.

In the deformed evacuation position, at least a portion of cell 230 is directed downward (e.g., open from below) such that ice within cell 230 may fall from ice tray 212. In some such embodiments, ice tray 212 is twisted about the axial direction X. For instance, first body wall 238 is circumferentially offset from or with the second body (e.g., relative to the axial direction X) to permit removal of ice from cell 230. The deformation caused by the circumferential offset may further motivate ice within cell 230 to fall from ice tray 212.

In certain embodiments, a frame stop 272 is provided (e.g., at first frame end 216) to engage ice tray 212. Frame stop 272 is generally fixed relative to frame assembly and may be provided thereon (e.g., as an integral unitary element with frame assembly). Thus, frame stop 272 may remain stationary even as ice tray 212 rotates between the receiving position and the evacuation position. In some such embodiments, frame stop 272 is positioned along the rotational path of at least a portion of ice tray 212, such as an axial foot 274 extending from first body wall 238 of ice tray 212. As shown, axial foot 274 may be radially spaced apart from the axial direction X and, optionally, parallel to the axial direction X. In the evacuation position, frame stop 272 may engage axial foot 274 such that uni-directional rotation at first body wall 238 is halted. In other words, frame stop 272 prevents further rotation of first body wall 238 in a single direction about the axial direction X (e.g., clockwise or whichever direction that ice tray 212 rotates from the receiving position to the evacuated position). Frame stop 272 may permit continued rotation of second body wall 240 (i.e., continued uni-directional rotation) such that second body wall 240 is rotated further to circumferentially offset from first body wall 238.

In optional embodiments, in the evacuation position, first body wall 238 is moved from the receiving position by a predetermined first angle between 90° and 130°. In additional or alternative embodiments, in the evacuation position, second body wall 240 is moved from the receiving position by a predetermined second angle between 120° and 180°. Additionally or alternatively, in the evacuation position, second body wall 240 may be circumferentially offset from the first wall by an offset angle between 10° and 90°.

As noted above, ice maker motor 228 is configured rotate ice tray 212 about axial direction X. Specifically, ice maker motor 228 may rotate ice tray 212 between the horizontal evacuation position and the deformed evacuation position. During use, water may be supplied to cell 230 (e.g., through central opening) while ice tray 212 is in the horizontal receiving position. Once water within cell 230 is frozen (e.g., as one or more ice cubes), ice maker motor 228 may be activated such that ice tray 212 is rotated (e.g., clockwise). First body wall 238 may rotate until frame stop 272 engages first body wall 238 (e.g., at axial foot 274), while second body wall 240 is further rotated (e.g., until the offset angle is reached between first body wall 238 and second body wall 240). Splash cover 214 may move along its non-rotational, vertical path as ice tray 212 rotates. Once ice has had the opportunity to fall from cell 230 (e.g., after a predetermined time period at the evacuation position), motor 228 may reverse rotation of ice tray 212 until the receiving position is reached.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice maker comprising:

an assembly frame;

an ice tray defining a cell for receipt of water for freezing, the ice tray being rotatably attached to the assembly frame to rotate about an axial direction;

a cam attached to the ice tray to rotate therewith, the cam extending along the axial direction;

a splash cover slidably attached to the assembly frame in mechanical communication with the cam to move between an elevated position and a lowered position according to a rotational position of the cam; and a biasing spring disposed on the splash cover, the biasing spring urging the splash cover to the lowered position, wherein the ice maker comprises a plurality of springs disposed on discrete locations of an upper surface of the splash cover to collectively urge the splash cover to the lowered position, and wherein the biasing spring is one spring of the plurality of springs, wherein the plurality of springs comprises a pair of springs disposed on opposite radial sides and proximal to opposite axial ends of the splash cover to prevent rotation of the splash cover during movement between the elevated position and the lowered position, wherein the ice tray extends along the axial direction between a first body wall and a second body wall, wherein the ice tray is rotatable about the axial direction between a horizontal receiving position corresponding to the lowered position and a deformed evacuation position, wherein the horizontal receiving position provides the first body wall in circumferential alignment with the second body wall to permit receipt of water within the cell, and wherein the deformed evacuation position provides the first body wall in circumferential offset with the second body to permit removal of ice from the cell.

2. The ice maker of claim 1, wherein the splash cover comprises an arcuate outer wall segment extending partially about the axial direction.

3. The ice maker of claim 1, wherein the splash cover comprises a pair of outer wall segments disposed at opposite radial sides of the assembly frame, and wherein the pair of outer wall segments is disposed radially outward from the ice tray.

4. The ice maker of claim 3, wherein the splash cover further comprises an intermediate wall segment extending between the pair of outer wall segments, and wherein the intermediate wall segment defines a central passage through which water may be received upstream from the cell.

5. The ice maker of claim 1, wherein the biasing spring is mounted above the ice tray and at least a portion of the splash cover.

6. The ice maker of claim 1, wherein the assembly frame extends along the axial direction between a first frame end and a second frame end, and wherein the assembly frame comprises a frame stop at the first frame end, the frame stop being engaged with the first body wall in the deformed evacuation position to halt uni-directional rotation at the first body wall.

7. The ice maker of claim 1, wherein the ice tray further comprises a first radial side and a second radial side extending between the first body wall and the second body wall, and wherein the splash cover comprises an outer wall segment having an outer surface and an inner surface, the outer surface facing away from the axial direction and radially outward therefrom, the inner surface facing toward the axial direction and defining a radial lip extending along a top surface of the first radial side in the horizontal receiving position.

8. An ice maker comprising:

an assembly frame;

an ice tray defining a cell for receipt of water for freezing, the ice tray being rotatably attached to the assembly frame to rotate about an axial direction;

a cam attached to the ice tray to rotate therewith, the cam extending along the axial direction;

a splash cover slidably attached to the assembly frame in mechanical communication with the cam to move along a non-rotational, vertical path between an elevated position and a lowered position according to a rotational position of the cam; and a plurality of springs disposed on the splash cover, the plurality of springs urging the splash cover to the lowered position, wherein the plurality of springs comprises a pair of springs disposed on opposite radial sides and proximal to opposite axial ends of the splash cover to prevent rotation of the splash cover during movement between the elevated position and the lowered position, wherein the ice tray extends along the axial direction between a first body wall and a second body wall, wherein the ice tray is rotatable about the axial direction between a horizontal receiving position corresponding to the lowered position and a deformed evacuation position, wherein the horizontal receiving position provides the first body wall in circumferential alignment with the second body wall to permit receipt of water within the cell, and wherein the deformed evacuation position provides the first body wall in circumferential offset with the second body to permit removal of ice from the cell.

9. The ice maker of claim 8, wherein the splash cover comprises an arcuate outer wall segment extending partially about the axial direction.

10. The ice maker of claim 8, wherein the splash cover comprises a pair of outer wall segments disposed at opposite radial sides of the assembly frame, and wherein the pair of outer wall segments is disposed radially outward from the ice tray.

11. The ice maker of claim 10, wherein the splash cover further comprises an intermediate wall segment extending between the pair of outer wall segments, and wherein the intermediate wall segment defines a central passage through which water may be received upstream from the cell.

12. The ice maker of claim 8, wherein the plurality of springs is mounted above the ice tray and at least a portion of the splash cover.

13. The ice maker of claim 8, wherein the assembly frame extends along the axial direction between a first frame end and a second frame end, and wherein the assembly frame comprises a frame stop at the first frame end, the frame stop being engaged with the first body wall in the deformed evacuation position to halt uni-directional rotation at the first body wall.

14. The ice maker of claim 8, wherein the ice tray further comprises a first radial side and a second radial side extending between the first body wall and the second body wall, wherein the splash cover comprises an outer wall segment having an outer surface and an inner surface, the outer surface facing away from the axial direction and radially outward therefrom, the inner surface facing toward the axial direction and defining a radial lip extending along a top surface of the first radial side in the horizontal receiving position.

* * * * *